United States Patent [19]

Zeltner

[11] Patent Number: 4,912,800

[45] Date of Patent: Apr. 3, 1990

[54] CLEANING DEVICE FOR GOLFERS AND CONSTRUCTION METHOD THEREFOR

[75] Inventor: Barry Zeltner, Littleton, Colo.

[73] Assignee: Barrick Partnership, Lakewood, Colo.

[21] Appl. No.: 232,306

[22] Filed: Aug. 15, 1988

[51] Int. Cl.[4] ..... A44B 21/00; A47K 10/02

[52] U.S. Cl. ..... 15/114; 15/210 R; 15/222; D6/608; 273/32 B

[58] Field of Search ..... 15/114, 209 R, 210 R, 15/222; D6/608

[56] References Cited

U.S. PATENT DOCUMENTS

| | | | |
|---|---|---|---|
| 1,031,586 | 7/1912 | Reinstein | 15/114 |
| 1,437,177 | 11/1922 | Hartman | 15/114 |
| 1,961,911 | 5/1934 | Pusch | 51/185 |
| 2,030,494 | 2/1936 | Bireley et al. | 15/227 |
| 2,682,678 | 7/1954 | Kingman | 15/118 |
| 2,754,532 | 7/1956 | Kanehl et al. | D6/608 X |
| 2,910,710 | 11/1959 | Corrington et al. | 15/118 |
| 3,169,264 | 2/1965 | Walker | 15/118 |
| 3,226,751 | 1/1966 | Lemelson | 15/118 |
| 3,350,736 | 11/1967 | Frazelle et al. | 15/114 X |
| 3,514,802 | 5/1970 | Keech | 15/118 |
| 3,982,298 | 11/1976 | Ota | 15/114 X |
| 4,224,712 | 9/1980 | Black et al. | 15/209 R |
| 4,403,366 | 9/1983 | Lucke | 15/209 R |

*Primary Examiner*—Chris K. Moore

*Attorney, Agent, or Firm*—Timothy J. Martin

[57] ABSTRACT

A cleaning device for golfers has a towel body and a brush member is secured at one corner thereof. The brush member carry perpendicular bristles for scrubbing golf implements and equipment, and the towel body provides a water absorbing medium to remove water from the implements and equipment. In the apparatus and method of this preferred invention, the brush member is mechanically fused to the fibers of the towel body, but in an alternate form, the brush member includes a mounting plate that is mechanically fused to the fibers of the towel body and a brush element is releasably secured to the mounting plate. This is accomplished by melting back web portions of the brush and compressing the molten portions and a portion of the towel body together to fuse the fibers and molten portions to one another. The brush member is contoured to fit the golfers hand and to simulate a golf green; the towel body is printed with graphic elements to simulate a golf hole. A clip may be mounted on a corner of the towel body opposite the brush member, so that, when the cleaning device is clipped to an erect golf bag, the towel body hangs uniformly alongside the golf bag.

20 Claims, 2 Drawing Sheets

CLEANING DEVICE FOR GOLFERS AND CONSTRUCTION METHOD THEREFOR

FIELD OF THE INVENTION

The present invention broadly relates to golf accessory items, but, more specifically, to the field of cleaning devices employed by golfers to clean their implements and equipment, such as, golf club, golf shoes, golf balls and the like. With greater particularity, the present invention is directed to a combined towel and brush ensemble which may be attached to a golfer's bag during play so as to be readily available when the golfers implements and equipment need immediate cleaning attention. The invention also relates to a construction method for this cleaning device.

BACKGROUND OF THE INVENTION

Since its early beginnings, approximately eight hundred years ago, golf has grown to be one of the world's great pastimes and enjoys popularity as a recreational sport throughout the world. Indeed, virtually every country in the world not only has residents who enjoy this sport but also has numerous golf courses constructed for this popular recreational activity. Golf is played on a golf course which is specifically designed for the game and which comprises a plurality of holes for play. Each hole has a tee box from which a golf ball is initially placed into play, a fairway and a cup into which the ball is to be stroked. The cup is surrounded by a putting green, and the fairway is flanked by a rough. Often obstacles, such as water hazards, sand traps (bunkers), trees, foliage (shrubs, cactus, undergrowth and the like) and pavilions (such as equipment sheds, shelters, refreshment stands and the like) offer impediments which are to be avoided during play.

Various implements and equipment are used by a golfer in participating in this popular sport. Of primary importance, aside from the golf ball itself, is a set of golf clubs which includes clubs known as "woods," "irons" and a "putter." The clubs are arranged in numerical order of increasing loft, that is, the angle of club face from the vertical. The clubs are designed to propel a golf ball a substantial distance as the golfer seeks to reach a putting green from the golf tee. The set of clubs is typically carried in a golf bag which also includes pouches which may carry various other golfing implements and equipment. Typically, a golfer carries a plurality of golf balls during the course of the play due to the ever-present danger of losing a golf ball to a hazard. In addition to the above-described equipment, many golfers wear specially constructed shoes which include cleats for providing firm footing for the golfer during his/her golf stroke.

During the course of the play, a golfer often experiences situations wherein various items of his/her equipment and implements become soiled during play. For example, the faces of the golf clubs can become covered with dirt or mud; since the face of a golf club is typically provided with scoring, in the form of grooves extending transversely across the face of the club, these grooves become filled with dirt which can affect the flight of the ball after striking. This risk is exacerbated by a proper golf stroke with one of the "irons" since proper technique quite often requires the golfer to cut into the ground (i.e. take a divot) with the club face to impart desired loft and spin to the ball. A golf ball itself becomes dirty during the play as a result of its impact with the ground, especially in damp or muddy locations. Further, as a result of these damp or muddy locations, a golfer's cleats and shoes may become caked with undesirable dirt and mud.

As a result of the long-felt need to keep one's implements and equipment clean, golfers have resorted to carrying towels or rags which may be employed to wipe the implements and equipment. However, such towels are often ineffective to provide means for thoroughly cleaning and polishing golf club faces, especially the scoring lines, or to effectively remove the dirt and mud from the cleats of one's golf shoes. While it is known that the use of bristled brushes are effective in providing an additional cleaning aid, it is often proved awkward or difficult to carry and use such brushes during a game. For example, should a golfer carry a brush in one of the pouches of one of the golf bag, there is a substantial likelihood that the pouch will become quite soiled from dirt remaining on the bush after use. Accordingly, while many golfers recognize the desirability of carrying a brush, few actually do so.

Accordingly, there is a well-established need for an improved cleaning device that may be used by golfers to clean golfing equipment and implements. An attempt was made to meet this need in U.S. Pat. No. 3,350,736 issued 7 November 1967 to Frazelle et al., which discloses a combined golfer's towel, brush and cleat cleaner. In this disclosure, a golfer's towel is contained within a tube that may be clipped to a golf bag. This tube is formed of a plastic material and carries, riveted thereto, a brush and cleat cleaner element. The towel is partially moistened and secured to the tubular container by means of a thong so that the towel may be removed for use and then reinserted into the container.

Despite the development of the combined cleaning device shown in Frazelle et al., there still remains a need for an inexpensive cleaning device which may be used by a golfer to clean his/her equipment and which is light weight, easy to carry and pleasing to the eye.

SUMMARY OF THE INVENTION

It is an object of the present invention to provide a new and useful cleaning device which may be employed by a golfer to clean his/her implements and equipment.

It is another object of the present invention to provide a portable cleaning device for golfers which is easily carried, for example, by attachment to a golf bag.

It is a further object of the present invention to provide a combination towel, body and brush member which may be carried on a golf bag and is constructed to hang in a uniform manner along the golf bag and to otherwise present a pleasing graphical appearance.

A still further object of the present invention is to provide a cleaning device for golfers that is inexpensive to produce and which may be used by a golfer to clean his/her implements and equipment while protecting the golfer's hands from getting soiled.

Yet another object of the present invention is to provide a method for constructing a cleaning apparatus in the form of a towel body and brush member for golfers which method allows the cleaning apparatus to be inexpensively produced in large quantity.

Accordingly, the cleaning device according to the present invention broadly includes a towel body that is constructed of a water absorbent material in the form of a panel having a front surface, a rear surface, a peripheral edge extending there around and a peripheral margin adjacent to the peripheral edge. A brush member is secured to the towel body on the front surface thereof. This brush member includes a plurality of stiff, resilient and elongated bristles that project generally perpendicularly outwardly from the front surface. This cleaning device is adapted to be secured to a golf bag for use by a golfer in order to clean his/her golfing implements and equipment, such as golf clubs, golf shoes, golf balls and the like. To this end, the brush member may be gripped by the golfer's hands and used to clean the scoring lines of the golf clubs, the cleats of the golf shoes, and to otherwise clean or polish the surfaces of the golf implements and equipment. The towel body is provided to remove excess moisture from the golfing items after cleaning, to allow the golfer to dry his/her hands, or to otherwise remove water from the golfing implements and equipment (such as the golf club grips) during inclement weather.

With greater particularity, the preferred embodiment of the present invention provides a brush element that may either be directly secured to the towel body or releasably secured by means of a mounting plate. To this end, the brush elements includes a flat back plate that has embedded therein the bristles, and the back plate may include a lip forme around its perimeter with this lip projecting oppositely, the bristles thereby defining a shallow cavity. The back plate is perfectly formed of plastic and includes webs which may be melted and fused into the fabric material to mechanically secure the back plate directly to the towel body. Alternately, the mounting plate may be constructed to be fused directly to the towel body, and the back plate is then releasably securable to the mounting plate by means of any convenient attachment technique such as hook and loop fasteners.

In either event, the brush member preferably has a contoured perimeter shaped to facilitate gripping of the brush element by the golfer's hand on the backside of the towel body opposite the front surface so that the towel body protects the golfer's during cleaning of the golfer's implements or equipment. Further, it is desirable that the brush member be configured to simulate the appearance of a golf green, and is preferably colored green. The front surface is then provided with graphic elements correlated with one another to simulate landscaping features of a golf hole, thereby providing a pleasing appearance. These landscaping elements may be selected from a group consisting of: tee boxes, fairways, sand traps, water hazards, trees, roughs, foliage and pavilions. Further, a clasp element is preferably secured to the towel body at a clasp location located within the peripheral margin. The clasp element is operative to secure the towel body to a golf bag, and the brush element is preferably attached to the towel body at substantially the maximum geometric distance away from the clasp location along the front surface whereby the brush member forms a weight operative to cause the towel body to hang uniformly along side the golf bag to which the clasp element is secured when the golf bag is placed in an erect position. Preferably the clasp element is secured by means of a metal grommet mounted in the peripheral margin of the towel body, and the towel body is preferably rectangular in shape.

The method, according to the preferred embodiment of the present invention is directed to the constructing of a cleaning device adapted for use by a golfer to clean his/her golfing implements and equipment. This method comprises the steps of first providing a towel body constructed of a water absorbent material having interlocking strands of fibrous material and also providing a brush member having a back plate formed of a plastic material with the back plate having a plurality of bristles projecting outwardly on the first thereof and a plurality of upstanding plastic webs each extending across a second side of the back plate opposite said first side. Next, the upstanding webs are heated until the webs are at the melting temperature of the plastic material thus forming molten portions. Finally, a front surface portion of the towel body is compressed against the molten portions of the webs to mechanically fuse the molten portions of the webs to mechanically fuse the molten portions of the webs into the interlocking strands of the towel body, thereby securing the brush member to the towel body. In the preferred method, it is desirable that the front surface of the towel body is printed with graphic elements correlated to one another to simulate landscaping features of a golf hole prior to securing the brush member to the towel body with these landscaping features being selected from a group consisting of: tee boxes, fairways, sand traps, water hazards, roughs, trees, foliage and pavilions. The brush member is preferably sized and configured to simulate a golf green and the step of securing the brush member to the towel body is undertaken such that the brush member is secured at a location to simulate the golf green of the golf hole. The preferred method also includes the steps of mounting a clasp element towel body at a location spaced apart from the location of the brush member.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to a cleaning device which is adapted to be secured to a golf bag for use by a golfer to clean his/her golfing implements and equipment and the invention also relates to a construction method therefor. In this broad form of the apparatus, the present invention includes a brush member which is directly connected to a towel body so that the brush and towel body may be used to clean score lines from the faces of the golf clubs, to clean golf cleats and to otherwise clean and polish the golf implements and equipment. The brush provides scrubbing and polishing elements, and the towel body provides a water absorbent mass to remove moisture from the golf equipment and implements either due to the cleaning operation or due to environmental conditions.

Figure 1:
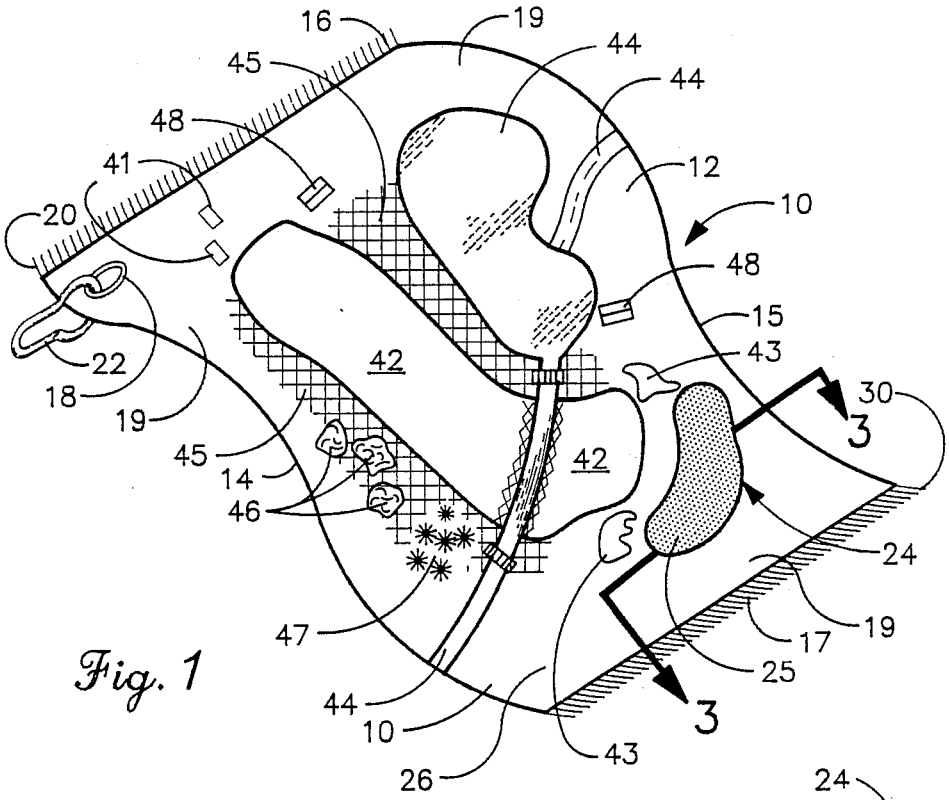
FIG. 1 is a perspective view of the golfer's cleaning device according to the preferred embodiment of the present invention.

As is best shown in FIG. 1, then, cleaning device 10 includes a towel body 12 in the form of a rectangular panel having side edges 14 and 15 and frayed end edges 16 and 17. Towel body 12 is constructed of any suitable water adsorbent material, but preferably is a woven and looped cloth material having interlocking strands of fibrous material, much in the manner of a terry cloth towel. A metal grommet 18 is mounted at corner 20 of towel body 12 and is operative to receive a clasp means in the form of clip 22 which is used to clip cleaning device 10 to a golf bag, as is described below. Towel body 12 is preferably rectangular in shape with edges 14–17 defining a perimeter therearound so that towel body has a peripheral margin 19 adjacent this perimeter. Grommet 18 is mounted in this peripheral margin 19.

A brush member 24 is secured to front surface 26 of towel body 24 adjacent corner 30 of towel body 12. The corner 30 is diagonally opposite corner 20 so that it should be understood that it is desirable to position brush member 24 at substantially the maximum geometric distance away from the location of grommet 18 and clip 22. While the construction of brush member 24 is described with greater particularity below, it may be recognized in FIG. 1 that brush member 24 has a contoured perimeter 25 shaped to facilitate gripping of the brush element by the golfer's hand on the backside of the towel body opposite the front surface 26. Further, it may be seen that brush member 24 is configured to simulate the appearance of a golf green, and front surface 26 of towel body 12 is provided with graphic elements correlated with one another to simulate landscaping features of a golf hole. Thus, as a seen in FIG. 1, front surface 26 may be provided with graphic elements such as tee boxes 41, fairway 42, sand traps 43, a water hazards 44 in the form of a lake and a stream, roughs 45, trees 46, foliage 47 and a pavilions 48. All of these landscaping features thus accoringly simulate a selected golf hole for purposes of providing cleaning device 10 with a pleasing and decorative appearance.

Figure 2:
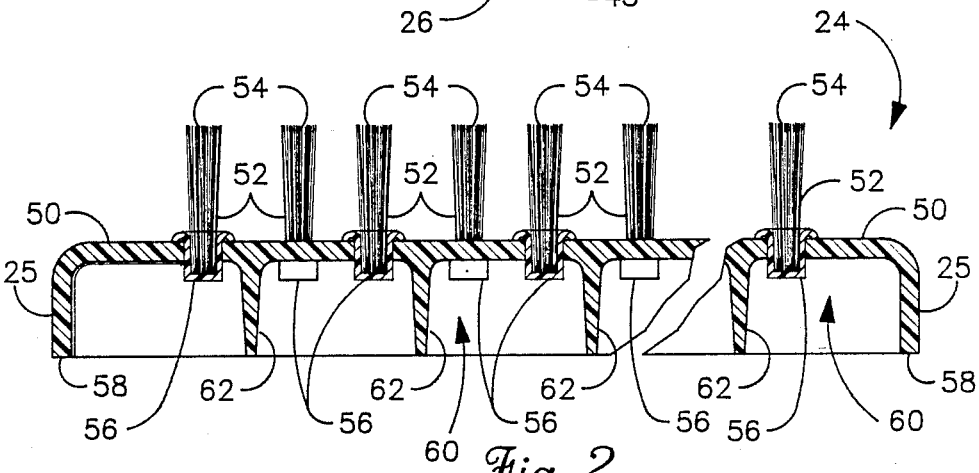
FIG. 2 is a cross-sectional view of the brush member according to the preferred embodiment of the present invention prior to mountings.

The preferred form of brush member 24 is shown in FIG. 2 prior to attachment to towel body 12. As is shown in FIG. 2, brush member 24 includes a relatively flat back plate 50 and a plurality of stiff, resilient and elongated bristles 52 which have free ends 54 adapted for use in scrubbing and polishing golfing implements and equipment with second ends 56 being embedded, in any suitable manner, in back plate 50. Bristles 52 are preferably colored green, to simulate the appearance of the golf green, as noted above, and also preferably extend generally perpendicularly outwardly from back plate 50. A lip 58 is formed around the perimeter of mounting plate 50 to form perimeter 25 of brush member 24 that is contoured to be grasped by the human hand. Lip 58 projects away from mounting plate 50 in a direction opposite bristles 52 to form a shallow cavity 60 therein. Cavity 60 is bridged by a plurality of upstanding webs 62 to facilitate in securing brush member 24 to towel body 12.

Figure 3:
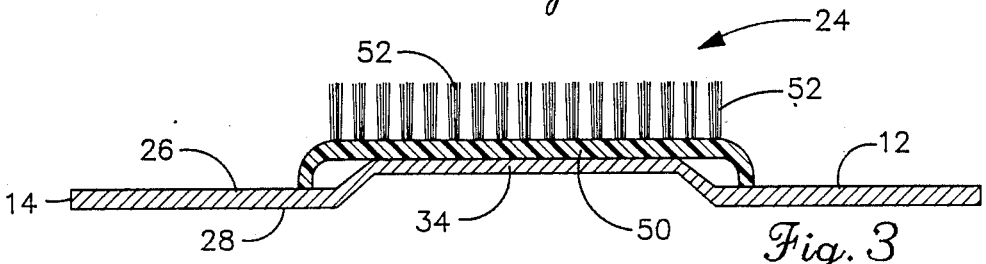
FIG. 3 is a cross-sectional view taken about lines 3—3 of FIG. 1.
Figure 4:
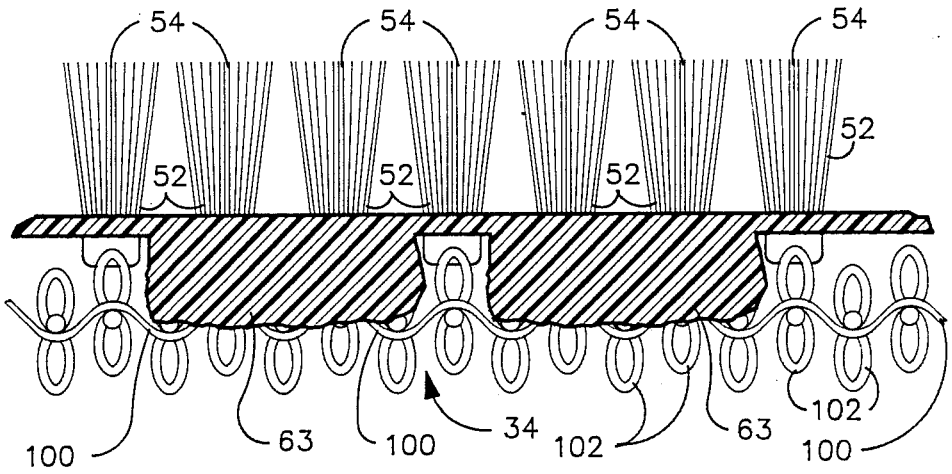
FIG. 4 is an enlarged cross-sectional view showing the attachment of the brush member to the towel body according to the preferred embodiment of the apparatus and method of the present invention.

As may be seen best in FIGS. 3 and 4, brush member 24 is secured to front surface 26, opposite back surface 28, of towel body 12 by mechanically fusing a fused portion 34 of towel body 12 in cavity 60. To this end, mounting plate 50 and its associated lip 58 and webs 62 is preferably formed of a plastic material so that webs 62 may be heated into molten portions 63 so that portion 34 of towel body 12 may be pressed against these molten portions as descirbed more thoroughly below. As is shown in FIG. 3, bristles 52 are oriented perpendicularly, then, to front surface 26 of towel body 12.

Figure 5:
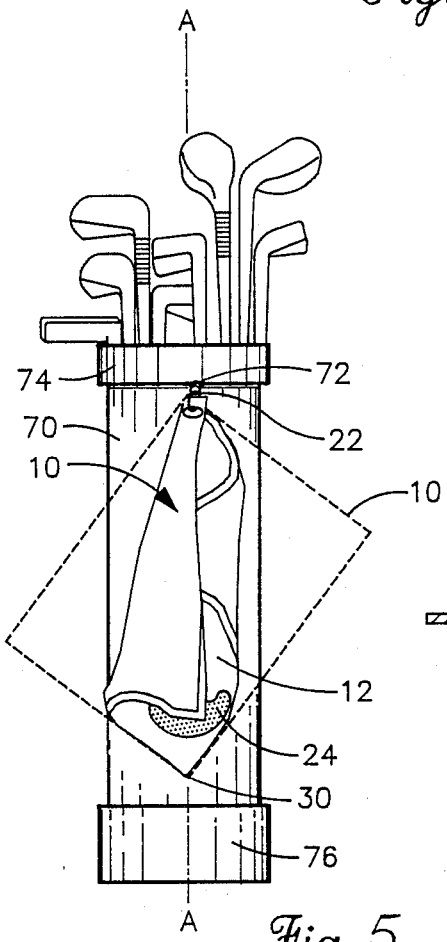
FIG. 5 is a side view in elevation showing the cleaning device according to the preferred embodiment of the present invention mounted to a golf bag in an erect position.

As may now be seen with respect to FIG. 5, cleaning device 10 may be conveniently clipped to a golf bag 70 which holds clubs 71. For example, clip 22 may be attached to a hook 72 formed on upper cuff 74 of bag 70. When bag 70 is oriented vertically or erect as is shown in FIG. 5, lower cuff 76 rests on the ground; it may be seen that corner 30 extends downwardly and is most proximate cuff 76. By positioning brush member 24 in closely spaced adjacent relation to corner 30, brush 24 forms a weight operative to cause towel body 12 of cleaning device 10 to hand uniformly alongside golf bag 70 under the weight of gravity. Accordingly, cleaning device 10, which is shown in FIG. 5, both in solid lines and in phantom, hangs alongside golf bag 70 and is oriented parallel to the longitudinal axis A.

The method of constructing cleaning device 10 according to the preferred embodiment of the present invention may now be more fully appreciated from the above description of the apparatus and in reference to FIG. 4. In the preferred method, cleaning device 10 is constructed by providing a towel body which is formed of a water absorbent material having interlocking strands of 100 and loops 102 fibrous material and having a front and back surface and by providing a brush member having a back formed of a plastic material with a back plate having a plurality of bristles projecting outwardly on a first side thereof and a first side of upstanding plastic webs, each extending across the second side of a back plate opposite the first side. The method then employs the step of heating the webs 62 until the webs 62 are at the melting temperature of the plastic material which form the brush member in order to form molten portions 63 on the second side of the back plate. Finally, a front surface portion 34 of the towel body is compressed against the molten portions 63 of the webs 62 with sufficient force to mechanically force the molten portions 63 into the interlocking strands of the fibrous material forming the towel body thus mechanically fusing the back plate to the front surface portion of the towel body so that the bristles 52 project generally perpendicularly outwardly from the front surface of the towel body.

In the preferred method of the present invention, it is desirable that the front surface of the towel body be printed with graphic elements correlated to one another to simulate landscaping features of a golf ball prior to securing the brush member to the towel body, as is shown in FIG. 1. It is preferred that this landscaping features be selected from a group consisting of: tee boxes, fairways, sand traps, water hazards, roughs, trees, foliage and pavilions. This graphic element may be printed by any convenient technique as is known in the art. Further, it is desirable in the preferred method to configure the brush member to simulate the shape of a golf green and to secure the brush member at a location on the front surface to simulate the golf hole represented by the graphic elements. It is further desirable in the preferred method to mount a clasp element to the towel body at a location spaced apart from the location of the brush member.

Figure 6:
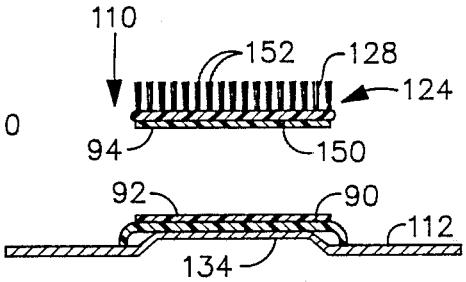
FIG. 6 is a cross-sectional view, similar to FIG. 3, showing an alternate embodiment of the brush member according to the present invention.

While it may be understood from the foregoing description that, in the preferred embodiment of the present invention, brush member 24 is permanently secured to towel body 12. However, in some instances it may be desirable that the brush member be removable to that the towel body may be laundered. While numerous releasable securing means can be constructed, one alternate embodiment of the present invention utilizes hook and loop fastening elements, as is shown in the alternate embodiment of cleaning device 110 shown in FIG. 6. Here, a mounting plate 90 is configured substantially identically to back plate 50, shown in FIGS. 2 and 3, but does not directly receive bristles embedded therein. As shown in FIG. 6, mounting plate 90 is mechanically fused to towel body portion 134 of towel body 112. A layer 92 of loop elements may then be affixed to mounting plate 90. Brush member 124 is then completed with the addition of brush element 128 which includes a flat back plate 150 into which are embedded bristles 152. Back plate 150 does not have a lip formed therearound but has affixed thereto a layer 94 of filiform elements which matably and releasably engage layer 92 of loop elements so that brush element 128 may be releasably secured to mounting plate 90, thus completing the assembly to brush member 124. Thus, brush element 128 may be conveniently removed for laundering towel body 112 of cleaning device 110.

Accordingly, the present invention has been described with some degree of particularity directed to the preferred embodiment of the present invention. It should be appreciated, though, that the present invention is defined by the following claims construed in light of the prior art so that modificaions or changes may be made to the preferred embodiment of the present invention without departing from the inventive concepts contained herein.

I claim:

1. A cleaning device which is adapted to be secured to a golf bag for use by a golfer to clean his/her golfing implements and equipment, such as golf clubs, golf shoes, golf balls and the like, comprising:

a towel body constructed of a water absorbent material in the form of a panel having a front surface, a rear surface, a peripheral edge extending therearound and a peripheral margin adjacent the peripheral edge;

a brush member secured to said towel body on the front surface thereof, said brush member including a plurality of stiff, resilient and elongated bristles projecting generally perpendicularly outwardly from said front surface; and mounting means for releasably mounting said towel body while in use at a point of attachment of said golf bag, said mounting means located in spaced apart relation to said brush member to suspend said brush member in spaced relation from the point of attachment so that said brush member can be easily and effectively maneuvered and employed by the golfer to clean his/her golfing implements and equipment without detaching said towel body from said golf bag.

2. A cleaning device according to claim 1 wherein said brush member includes a flat back plate, said bristles having first ends being embedded in said back plate and second ends opposite said first ends, said second ends forming free scrubbing and polishing ends operative to clean said golfing implements and equipment.

3. A cleaning device according to claim 2 wherein said back plate is formed of a meltable substance, said back plate and said towel body having fused portions mechanically attaching said brush member to said towel body.

4. A cleaning device according to claim 1 where said brush member has a contoured perimeter shaped to facilitate gripping of the brush element by the golfer's hand on a back side of the towel body opposite said front surface whereby the golfer's hand is protected during use of the brush member.

5. A cleaning device according to claim 4 wherein said brush member is further configured to simulate the appearance of a golf green.

6. A cleaning device according to claim 5 wherein said bristle elements are colored green and wherein said front surface is provided with graphic elements correlated with one another to simulate landscaping features of a golf hole.

7. A cleaning device according to claim 6 wherein said landscaping features are selected from a group consisting of: tee boxes, fairways, sand traps, water hazards, trees, roughs, foliage and pavilions.

8. A cleaning device according to claim 1 wherein said mounting means includes a clasp element secured to said towel body at a clasp location in said peripheral margin and operative to secure the towel body to a golf bag, said brush member being attached to said towel body at substantially the maximum geometric distance away from said clasp location along said front surface whereby said brush member forms a weight operative to cause said towel body to hang uniformly alongside the golf bag to which said clasp element is secured when the golf bag is placed in an erect position.

9. A cleaning device which is adapted to be secured to a golf bag for use by a golfer to clean his/her golfing implements and equipment, such as golf clubs, golf shoes, golf balls and the like, comprising:

a towel body constructed of a water absorbent material in the shape of a rectangular panel having a front surface, a rear surface, a peripheral edge extending therearound and a peripheral margin adjacent the peripheral edge;

clasp means on a first corper of said towel body for releasably securing the towel body while in use to a point of attachment on said golf bag; and a brush member secured to said towel body adjacent a second corner of said towel body diagonally opposite said first corner, said brush member includig a flat back plate secured to the front surface of said towel body and having a plurality of elongated bristles projecting generally perpendicularly outwardly from said front surface to terminate in free ends operative for use in scrubbing and polishing said golfing implements and equipment and whereby said brush element forms a weight operative to cause said towel body to hang uniformly alongside golf bag when said clasp means secures the towel body thereto and when the golf bag is placed in an erect position such that said brush member is longitudinally spaced from the point of attachment to suspend said brush member while in use so that said golfer can easily and effectively maneuver said brush member to clean his/her golfing implements and equipment without detaching said towel body from said golf bag.

10. A cleaning device according to claim 9 wherein said bristles have second ends opposite their respective said free ends, said second ends being affixed to said back plate.

11. A cleaning device accordin to claim 10 wherein said back plate is constructed of a plastic material and wherein said back plate is mechanically fused to said towel body.

12. A cleaning device according to claim 9 wherein said brush member has a contoured perimeter shaped both to facilitate gripping by a golfer's hand and to simulate the appearance of a golf green and including graphic elements on said front surface, said graphic elements correlated with one another to simulate landscaping features of a golf hole selected from a group consisting of: tee boxes, fairways, sand traps, water hazards, trees, roughs, foliage and pavilions.

13. A method of constructing a cleaning device which is adapted for use by a golfer to clean his/her golfing implements and equipment, comprising the steps of:

providing a towel body constructed of a water absorbent material having interlocking strands of fibrous material and having a front surface;

providing a brush membe having a back plate formed of a plastic material with the back plate having a plurality of bristles projecting outwardly on a first side thereof and having a plurality of upstanding plastic webs each extending across a second side of said back plate opposite said first side;

heating said webs until the webs are at the melting temperature of said plastic material to form molten portions: and compressing a front surface portion of the towel body against the molten portions of said webs to mechanically fuse the molten portions of the webs into the interlocking strands of said towel body thereby securing said brush member thereto.

14. The method according to claim 13 including the step of printing the front surface of said towel body with graphic elements correlated to one another to simulate landscaping features of a golf hole prior to securing the brush member to said towel body, said landscaping features being selected from a group consisting of: tee boxes, fairways, sand traps, water hazards trees, roughs, foliage and pavilions.

15. The method according to claim 14 wherein said brush member is sized and configured to simulate a golf green and is secured to the front surface of said towel body at a location to simulate the golf green of said golf hole.

16. A method according to claim 15 including the step of mounting a clasp element to said towel body at a location spaced apart from the location of the brush member.

17. A cleaning device which is adapted to be secured to a golf bag for use by a golfer to clean his/her golfing implements and equipment, such as golf clubs, golf shoes, golf balls and the like, comprising:

a towel body constructed of a water absorbent material in the form of a panel having a front surface, a rear surface, a peripheral edge extending therearound and a peripheral margin adjacent the peripheral edge; and a brush member including a flat back plate having a lip formed around its perimeter to define a shallow cavity and including a plurality of stiff, resilient and elongated bristles having first ends being embedded in said back plate and second ends opposite said first ends, said towel body having a portion thereof received in the shallow cavity, said flat back plate being mechanically adhered to said towel body such that said bristles project outwardly from the front surface of said towel body to form free scrubbing an polishing ends operative to clean said golfing implements and equipment.

18. A cleaning device which is adapted to be secured to a golf bag for use by a golfer to clean his/her golfing implements and equipment, such a golf clubs, golf shoes, golf balls and the like, comprising:

a towel body constructed of a water absorbent material in the form of a panel having a front surface, a rear surface, a peripheral edge extending therearound and a peripheral margin adjacent the peripheral edge;

a mounting member attached to the front surface of said towel body;

a brush member including a back plate and a plurality of stiff, resilient and elongated bristles, said bristles having first ends being embedded in said back plate and second ends opposite said first ends, said second ends forming free scrubbing and polishing ends operative to clean said golfing implements and equipment; and means for releasably securing said back plate to said mounting member whereby said brush member is releasably secured to said towel body with said bristles projecting outwardly from the front surface thereof.

19. A cleaning device which is adapted to be secured to a golf bag for use by a golfer to clean his/her golfing implements and equipment, such as golf clubs, golf shoes, golf balls and the like, comprising:

a towel body constructed of a water absorbent material in the form of a panel having a front surface, a rear surface, a peripheral edge extending therearound and a peripheral margin adjacent the peripheral edge; clasp means on a first corner of said towel body for releasably securing the towel body to said golf bag;

a mounting member attached to the front surface of said towel body adjacent a second corner of said towel body diagonally opposite said first corner;

a brush member including a flat back plate and a plurality of elongated bristles projecting generally perpendicularly outwardly from said back plate to terminate in free ends operative for use in scrubbing and polishing said golfing implements and equipment, said bristles having second ends opposite their respective free ends, said second ends being affixed to said back plate; and means for releasably securing said back plate to said mounting member whereby said brush member forms a weight operative to cause said towel body to hang uniformly alongside said golf bag when said clasp means secures the towel body thereto and when the golf bag is placed in an erect position.

20. A cleaning device according to claim 19 wherein said mounting member is constructed of a plastic material and wherein said mounting member is mechanically fused to said towel body.

* * * * *

US004912800B1

REEXAMINATION CERTIFICATE (3102nd)

United States Patent [19] [11] B1 4,912,800

Zeltner [45] Certificate Issued Jan. 14, 1997

[54] CLEANING DEVICE FOR GOLFERS AND CONSTRUCTION METHOD THEREFOR

[75] Inventor: Barry Zeltner, Littleton, Colo.

[73] Assignee: Recreative Technologies Corporation

Reexamination Request:
No. 90/002,613, Jan. 6, 1992

Reexamination Certificate for:

| | |
|---|---|
| Patent No.: | **4,912,800** |
| Issued: | **Apr. 3, 1990** |
| Appl. No.: | **232,306** |
| Filed: | **Aug. 15, 1988** |

[51] Int. Cl.[6] ..... A44B 21/00; A47K 10/02

[52] U.S. Cl. ..... 15/114; 15/210.1; 15/222; 473/407; D6/608

[58] Field of Search ..... 15/114, 209.1, 15/210.1, 222; D6/608

[56] References Cited

U.S. PATENT DOCUMENTS

| | | |
|---|---|---|
| 2,230,312 | 2/1941 | Sieb et al. . |
| 2,778,044 | 1/1957 | Mikulski . |
| 2,980,936 | 4/1961 | Snow et al. . |
| 3,040,357 | 6/1962 | Bellini . |
| 4,004,376 | 1/1977 | Schepp . |

OTHER PUBLICATIONS

Brochure of Cliff Castle & Co., Huntington Beach, Calif, for golf accessories, dated 1987–1988.

Magic Threads advert. flyer for "Bigg Bigg Raggs", Aug. 30, 1986.

Magic Threads price list for "Bagg Raggs", 1 Feb. 1985.

Magic Threads news release in *Berkeley Nissan News*, Oct.–Nov. 1985.

*Primary Examiner*—Chris K. Moore

[57] ABSTRACT

A cleaning device for golfers has a towel body and a brush member is secured at one corner thereof. The brush member carry perpendicular bristles for scrubbing golf implements and equipment, and the towel body provides a water absorbing medium to remove water from the implements and equipment. In the apparatus and method of this preferred invention, the brush member is mechanically fused to the fibers of the towel body, but in an alternate form, the brush member includes a mounting plate that is mechanically fused to the fibers of the towel body and a brush element is releasably secured to the mounting plate. This is accomplished by melting back web portions of the brush and compressing the molten portions and a portion of the towel body together to fuse the fibers and molten portions to one another. The brush member is contoured to fit the golfers hand and to simulate a golf green; the towel body is printed with graphic elements to simulate a golf hole. A clip may be mounted on a corner of the towel body opposite the brush member, so that, when the cleaning device is clipped to an erect golf bag, the towel body hangs uniformly alongside of golf bag.

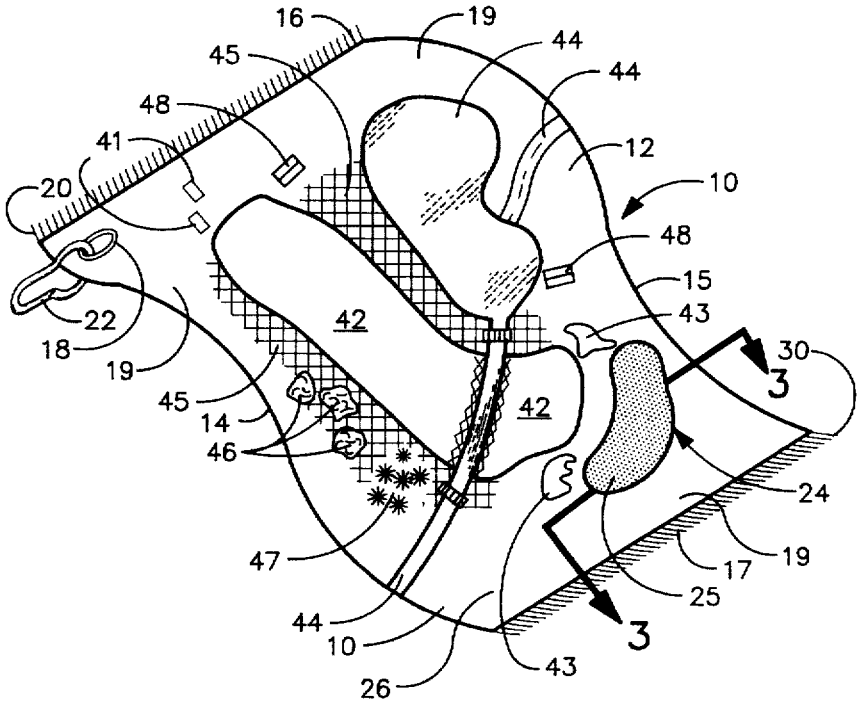

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–20 is confirmed.

* * * * *